US008139805B2

(12) United States Patent
Tsai

(10) Patent No.: US 8,139,805 B2
(45) Date of Patent: Mar. 20, 2012

(54) SPEAKER APPARATUS

(76) Inventor: Jen-Hui Tsai, Taipei (TW)

( * ) Notice: Subject to any disclaimer, the term of this patent is extended or adjusted under 35 U.S.C. 154(b) by 329 days.

(21) Appl. No.: 12/507,407

(22) Filed: Jul. 22, 2009

(65) Prior Publication Data

US 2010/0183185 A1 Jul. 22, 2010

(30) Foreign Application Priority Data

Jan. 19, 2009 (TW) ..... 98200939 U

(51) Int. Cl.
*H04R 1/20* (2006.01)
*H04R 25/00* (2006.01)

(52) U.S. Cl. ..... 381/351; 381/150; 381/165; 381/345

(58) Field of Classification Search ..... 381/150, 381/165, 345, 351, 386, 396–397, 411; 181/153; D14/204, 206, 224
See application file for complete search history.

(56) References Cited

U.S. PATENT DOCUMENTS 2,846,520 A * 8/1958 Brownscombe ..... 381/430
7,922,015 B2 * 4/2011 Bassetti ..... 211/74
2002/0154788 A1 * 10/2002 Tsai ..... 381/345
* cited by examiner

*Primary Examiner* — Davetta W Goins
*Assistant Examiner* — Matthew Eason
(74) *Attorney, Agent, or Firm* — Shoemaker and Mattare

(57) ABSTRACT

A speaker apparatus includes a speaker and a sound box. The sound box is shaped like a wine barrel and includes arced side boards and parallel top and bottom boards coupled to upper and lower ends of the side boards, respectively. The sound box is divided by at least an isolating board into air chambers interconnected with one another via at least an air aperture formed in the isolating board, and at least an air venting hole is formed through at least one of the side boards so as to communicate the air chambers with the outside. The speaker is installed on the top board via an installation hole formed therein. The interconnected air chambers and side boards produce air cushions corresponding to resonant frequency sections of the speaker, thereby enabling the speaker to reproduce original audio sounds without interfering with a successively formed air cushion.

8 Claims, 5 Drawing Sheets

SPEAKER APPARATUS

BACKGROUND OF THE INVENTION

1. Field of the Invention

The present invention relates in general to a speaker apparatus, and more particularly to a speaker apparatus having a plurality of air chambers.

2. Description of the Prior Art

Speakers are used in various types of communications and entertainment equipment, such as radio and television receivers, and stereo home entertainment systems. The most common speaker apparatus is the dynamic speaker apparatus that consists of a frame, permanent magnet, soft iron core, voice coil, and a cone. The frame supports the cone and permanent magnet assembly. The voice coil consists of an insulated wire wound around a plastic bobbin. One end of the bobbin is attached to the cone and the body of the bobbin slides over the soft iron core. Although this design is well-established, the industry is constantly experimenting with new techniques and materials to improve sound quality, frequency response, and power output.

FIG. 1 illustrates a cutaway view of a conventional speaker apparatus having a sound box 100 with an independent air chamber 101 formed therein. An air-venting hole 102 is formed on a sidewall surface of the sound box 100 interconnected with the air chamber 101 of the sound box 100. At least an installation hole 103 is formed on top of the air-venting hole 102 to accommodate a speaker 120. The speaker 120 consists of a frame 122 and a cone 124 disposed within the frame 122. Permanent magnets 126 are disposed at the rear of the frame 122, and, close to an end of permanent magnets 126, the cone 124 has a moving coil 128. Additionally, a damper 130 is further disposed between the moving coil 128 and the frame 122. Upon an audio-frequency signal being input into the speaker 120, the moving coil 128 is induced with a corresponding electric current, thus causing the moving coil 128 to be an electric magnet, such that the permanent magnets 126 attract the moving coil 128 rearward (to the left in the fig.) and concurrently pull on the damper 130. Then, after the current and magnetic force cease, the moving coil 128 and the cone 124 springs forward (to the right in the fig.) by the elasticity of the damper 130, thus enabling the cone 124 to produce sound by compressing the air in front of the cone 124.

In the theory of sound creation of the conventional speaker apparatus as described above, the reason the conventional speaker apparatus employs the construction of the sound box as depicted in FIG. 1 is due to the inability to obtain a suitable damper 130 that provides adequate elasticity within the range of the resonance frequency of the speaker 120. Generally speaking, an overly rigid damper would cause the cone 124 to spring back too soon, thus failing to produce good low frequencies, i.e. the bass sound. Conversely, a too elastic damper does not enable the cone 124 to spring back quick enough in order to produce good high frequencies, i.e. the treble sound. As a solution, it is common practice for conventional speakers to have less rigid dampers installed on the sound box 100, so that permanent magnets 126 can be used to attract the moving coil 128 rearward to allow the cone 124 to compress the air at the rear of the speaker 120 via an aperture 132 formed in the frame 122, thereby producing a nearly instant air cushion to aid the damper 130 in producing better high audio frequencies. The air cushion described above is generated and then dissipated almost instantly through the air venting hole 102 after completing the intended task. In theory, in the design of a conventional speaker apparatus, different pressures are required to produce different audio frequencies in each of the resonant frequency sections in order to provide optimal response. In practice, however, it is difficult for a single stationary air chamber 101 disposed within the sound box 100 to produce the different air cushions required for producing the desired audio frequencies. And, even if it were possible to produce differing air cushions from a single sound box 100, the air venting hole 102 with a fixed diameter may not be able to vent the differing air cushions as quickly as required, such that interference among successive air cushions may occur and thus degrade the sound quality of the speaker.

To address this issue, the inventor of the present invention previously proposed a solution that improved on the limitations associated with prior art speakers, as illustrated in FIG. 2. New Design Publication No. 486219 owned by the applicant has disclosed a speaker apparatus characterized by defining a plurality of air chambers 22*a*, 22*b*, 22*c*, 22*d* within the sound box 20 of the speaker 21, wherein the plurality of air chambers 22*a*, 22*b*, 22*c*, 22*d* are provided with a plurality of air venting hole 23*a*, 23*b*, 23*c*, 23*d* formed therein, respectively, and communicate with the outside, with the air chamber 22*d* having an additional air venting hole 23*e*, and air apertures 24*a*, 24*b*, 24*c* communicating with adjacent ones of the air chambers. At least one of the plurality of air chambers 22*a*, 22*b*, 22*c*, 22*d* enables the rear of the speaker 21 to generate instant air cushions matching at least one of the resonant frequency sections to produce the desired audio frequencies of the speaker 21, while allowing the air cushions to effectively disperse via air venting holes 23*a*, 23*b*, 23*c*, 23*d*, 23*e* and thus not interfere with successively formed air cushions, thereby providing suitable and detached air cushions for matching with each of the resonant frequency sections to produce the desired audio frequencies of the speaker 21. However, the sound box 20 is a rectangular-shaped structure having parallel and perpendicular wall surfaces formed within, which does not match with the shape of the cone of the speaker 21, causing weak expansion capability and compromising the efficacy of the audio speaker 21. Although it is possible to produce the sound box 20 using new raw materials to provide a shape that better conforms to the cone of the speaker, this further increases the manufacturing costs.

As such, it is desirable to provide an improved speaker apparatus that is capable of enhancing the overall efficacy of the speaker while reducing the cost of manufacture.

SUMMARY OF THE PRESENT INVENTION

In view of the above problems, the present invention proposes a speaker apparatus including a speaker and a sound box, the sound box having the shape of a wine barrel and formed by a plurality of arced side boards, a top board coupled to the upper ends of the side boards, and an opposite bottom board coupled to the lower ends of the side boards, the top and bottom boards being parallel to each other, wherein the sound box is divided by at least an isolating board into a plurality of air chambers, wherein the plurality of air chambers are interconnected with one another via at least an air aperture formed through the at least an isolating board and at least an air venting hole is formed through at least one of the arced side boards for communicating the plurality of air chambers with the outside, and the top board having at least an installation hole formed therein for installing a speaker therein. Further, the wine barrel shape of the sound box means that the diameter in the middle of the sound box is larger than the diameters of the upper and lower portions thereof.

In a preferred embodiment, the at least an air venting hole is formed in at least one of the arced side boards in position corresponding to at least one of the plurality of air chambers.

In another preferred embodiment, the at least an air aperture and the at least an air venting hole each is further mounted with an one-way valve for limiting air flow to a single intended direction.

Compared to the conventional speakers, the speaker apparatus proposed by the present invention is characterized by employing a sound box formed by a finished oak barrel, and further using the arced side boards formed in the sound box to match with the shape of the cone of the speaker, thereby enabling the speaker to reproduce original audio sounds and facilitating reclamation of used oak buckets or barrels, thus overcoming the drawbacks of compromised audio efficacy and providing reduced manufacturing costs.

BRIEF DESCRIPTION OF THE DRAWINGS

The above and other objectives, features and advantages of the present invention will be more clearly understood from the following detailed description taken in conjunction with the accompanying drawings, in which.

DETAILED DESCRIPTION OF THE PREFERRED EMBODIMENTS

The following illustrative embodiments are provided to illustrate the disclosure of the present invention. The details of the specification may be changed on the basis of differing points and applications, and numerous modifications and variations can be devised without departing from the spirit of the present invention.

The First Embodiment

Figure 1:
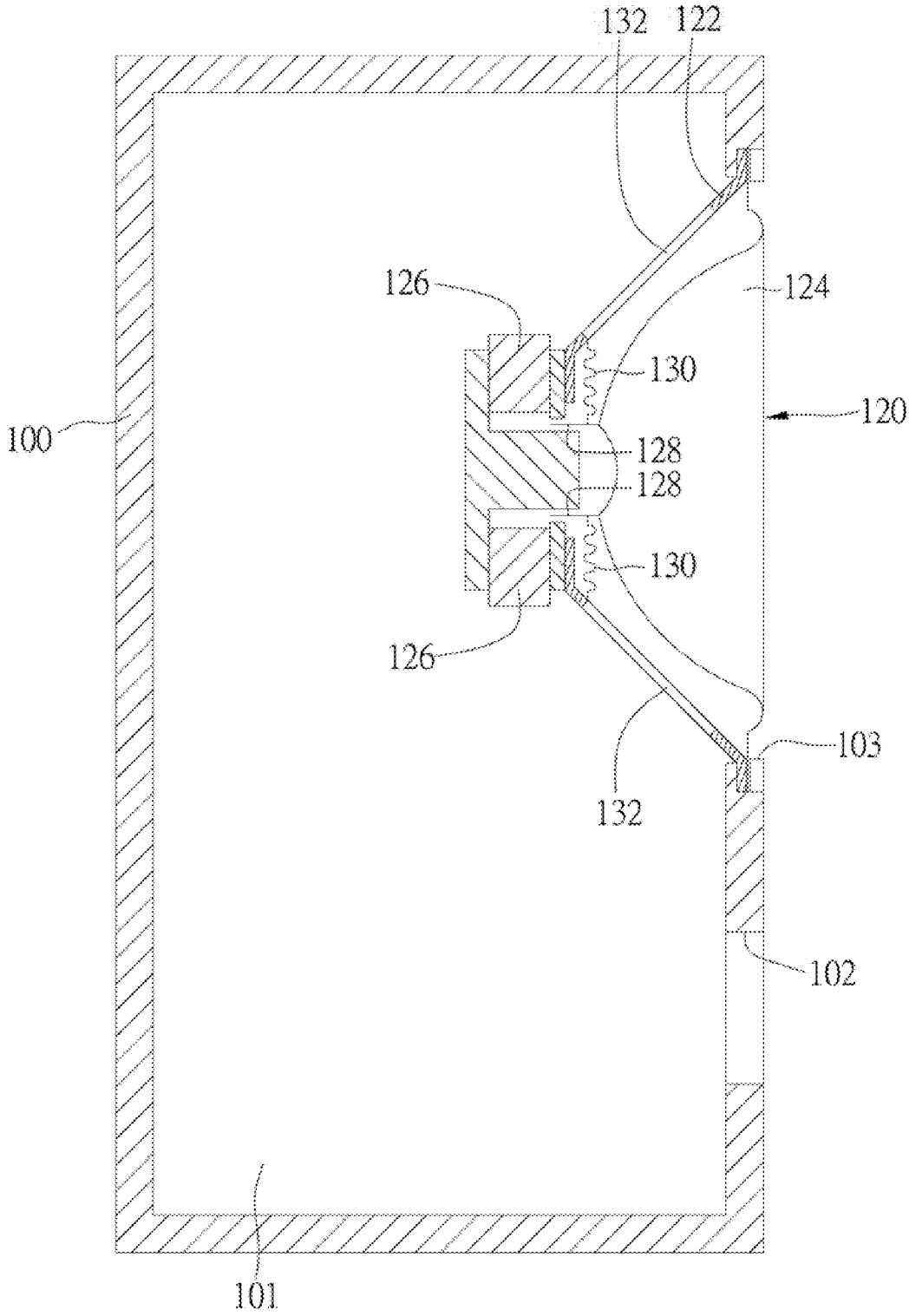
FIG. 1 (PRIOR ART)
FIG. 1 is a cutaway view illustrating the structure of a conventional speaker apparatus.
Figure 2:
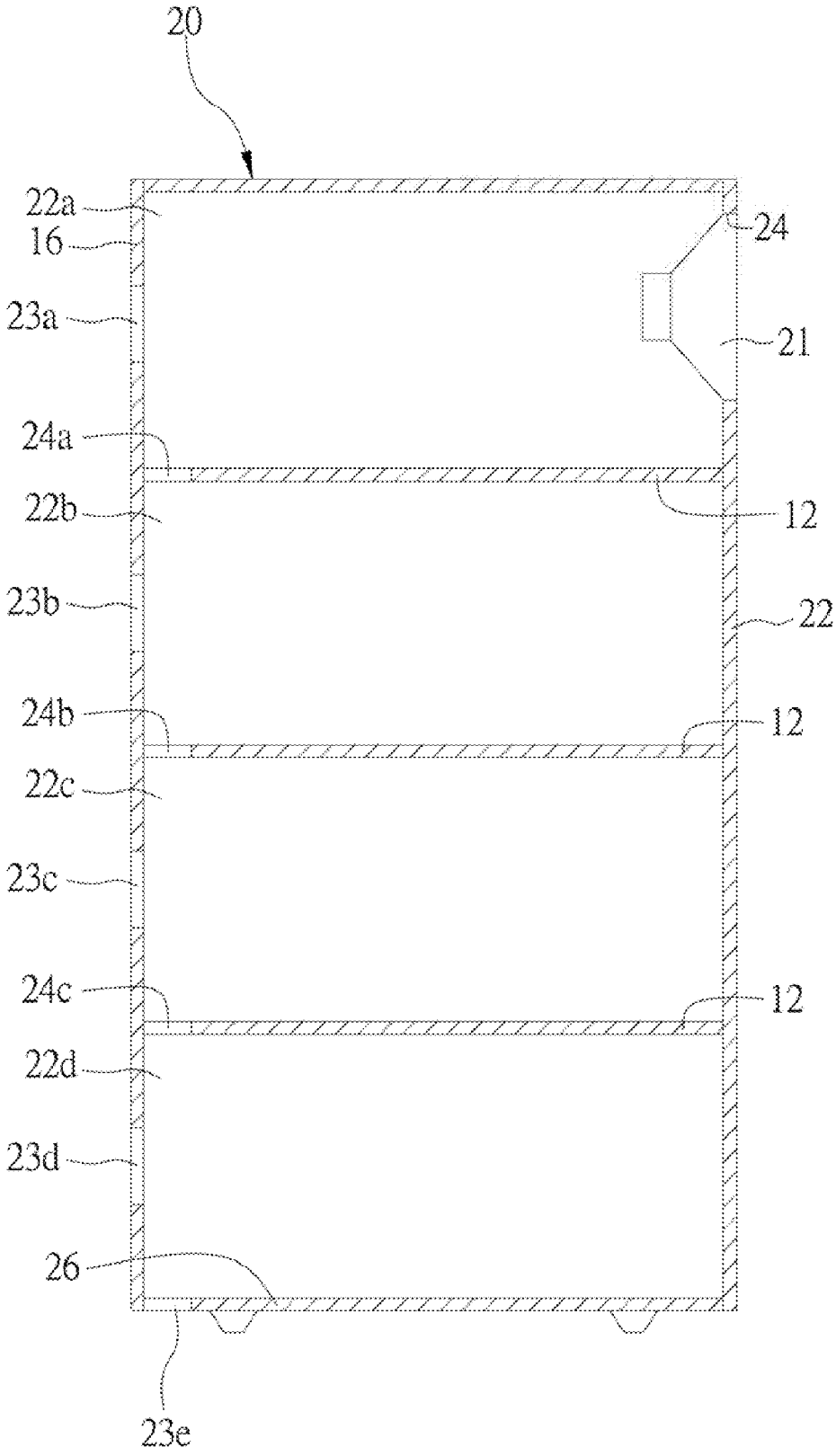
FIG. 2 (PRIOR ART)
FIG. 2 is side cutaway view illustrating the structure of the speaker apparatus as disclosed in Taiwanese Patent Application No. 486219.
Figure 3A:
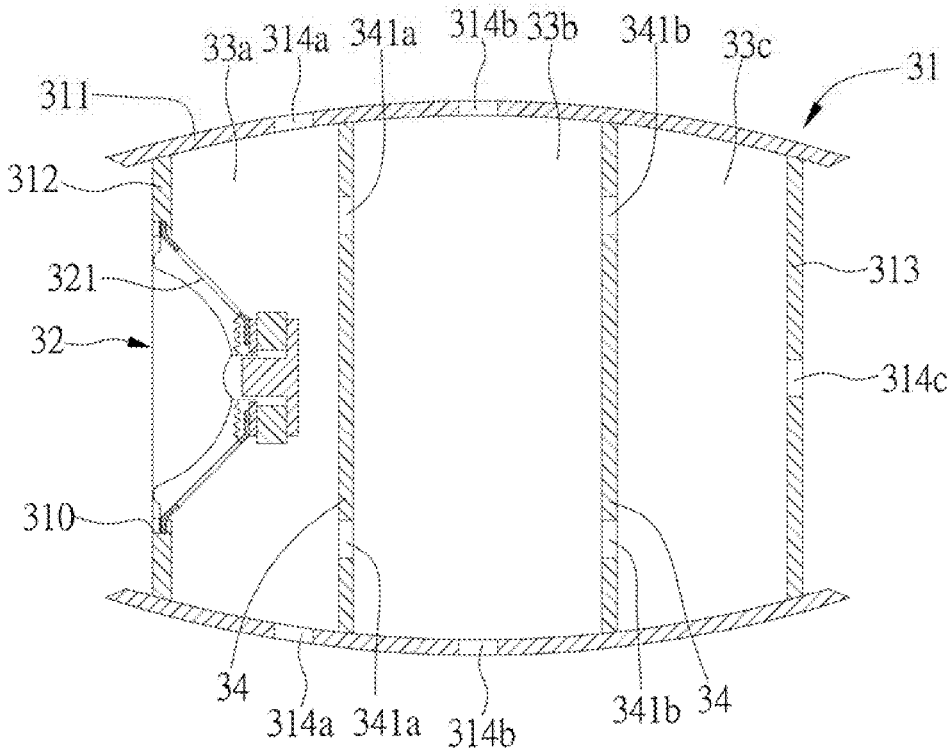
FIG. 3A is a side cutaway view illustrating the speaker apparatus in accordance with a first preferred embodiment of the present invention.
Figure 3B:
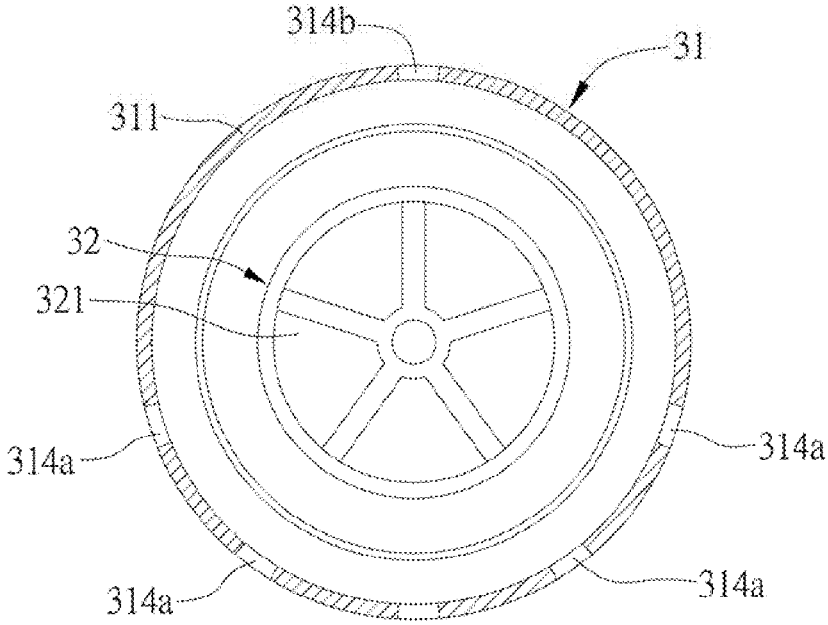
FIG. 3B is a front cutaway view illustrating the speaker apparatus in accordance with the first preferred embodiment of the present invention.
Figure 4:
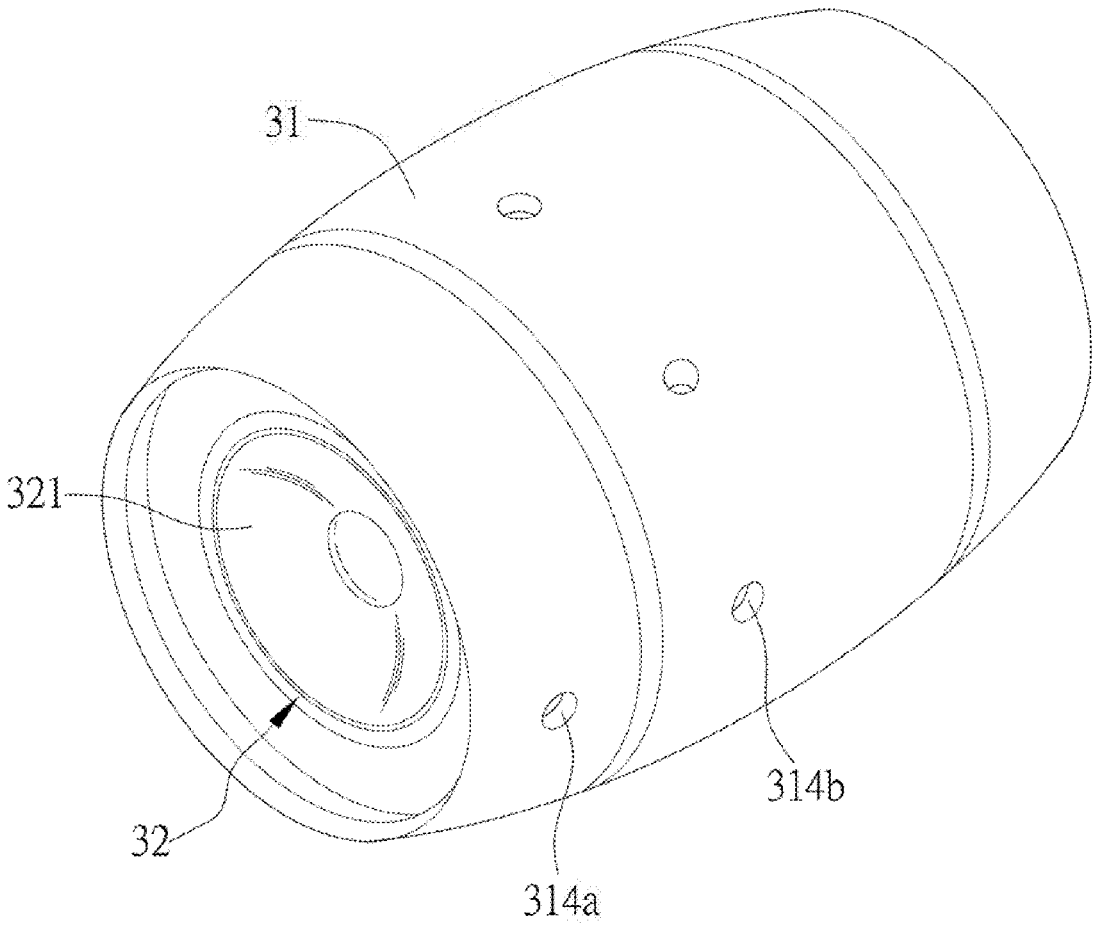
FIG. 4 is a three-dimensional outlined view illustrating the speaker apparatus in accordance with the first preferred embodiment of the present invention.

FIGS. 3A, 3B, and FIG. 4 respectively depict a side cutaway view, front cutaway view and a three-dimensional outlined view of the speaker apparatus in accordance with the first preferred embodiment of the present invention. As shown, the speaker apparatus of the present invention consists of a sound box 31 and a speaker 32. The sound box 31 is of the shape of a wine barrel and is formed by a plurality of arced side boards 311, a top board 312 connecting with the upper ends of the side boards 311, and a bottom board 313 connecting with the lower ends of the side boards 311, the top and bottom boards 312, 313 being parallel with each other, wherein the wine barrel shape means that the diameter in the middle of the sound box 31 is larger than the diameters of the upper and lower portions thereof. At least an installation hole 310 is formed in the top board 312 for mounting a speaker therein. In this embodiment, the sound box 31 is divided by two isolating boards 34 into three air chambers 33*a*, 33*b*, 33*c*, wherein the isolating board 34 has a plurality of air aperture 341*a* (for the left isolating board), 341*b* (for the right isolating board) formed therein. The air chambers 33*a*, 33*b*, 33*c* are interconnected with one another via at least one of the plurality of air aperture 341*a*, 341*b*. In practice, at least an isolating board 34 divides the sound box 31 into the plurality of air chambers 33*a*, 33*b*, 33*c*. Air venting holes 314*a*, 314*b* in communication with the air chambers 33*a*, 33*b* are formed on the arc side boards 311 in position corresponding to air chamber 33*a* and 33*b*, and an air venting hole 314*c* is formed on the bottom board 313 of the sound box 31. The air venting holes 314*a*, 314*b*, 314*c* are in communication with the outside. Note that the number and configuration of air apertures 341*a*, 341*b* and air venting holes 314*a*, 314*b*, 314*c* to be formed on isolating boards 34 and the side boards 311 may vary depending on the actual requirements. The speaker 32 is mounted in the at least an installation hole 310 of the top board 312, the speaker 32 having a cone 321 with the capable of producing vibration, the axis of the speaker 32 being perpendicular to the installation plane of isolating boards 34.

The number of air chambers 33*a*, 33*b*, 33*c* corresponds to the resonant frequency ranges of the speaker 32. In this embodiment, the sound box 31 is divided into three air chambers 33*a*, 33*b*, 33*c*, and there are three different frequency sections, A, B, C each corresponding to a resonant frequency range of the speaker 32. In the A frequency section of the resonant frequency range of the speaker 32, the cone 321 of the speaker 32 moved backward and generates a nearly instant air pressure wave into air chamber 33*a*, and, before the generated air pressure wave is dispersed through the air venting hole 314*a* and the air aperture 341*a*, an air cushion is formed that enabling sounds to be produced by the speaker 32 in the A frequency section. The air cushion is then vented out through the air venting hole 314*a* and the air aperture 341*a* effectively without causing interference with successively formed air cushions.

In the B frequency section of the speaker resonant frequency range, the relative short wavelength of the cone 321 of the speaker 32 resulting from compressing the air in the rear of the speaker 321 begins to expand into air chamber 33*b* via the air venting hole 341*a* before an air cushion can be generated in air chamber 33*a*. The wavelength of the air flow is not short enough to allow it to keep expanding into air chamber 33*c*. Then, a less dense air cushion is formed in the interconnected air chambers 33*a*, 33*b* to allow the speaker 32 to produce sounds in the B frequency section. The air cushion is then effectively vented out through air venting holes 314*a*, 314*b* and the air aperture 341*b* without causing interference with successively formed air cushion.

Similarly, in the C frequency section of the speaker resonant frequency range, corresponding air cushions are formed in the interconnected air chambers 33*a*, 33*b* and 33*c*, respectively, and thereafter air cushions are dissipated through air venting hole 314*a*, 314*b*, 314*c* after completing their intended tasks, to thereby prevent interference with successively formed air cushions.

The Second Embodiment

Figure 5:
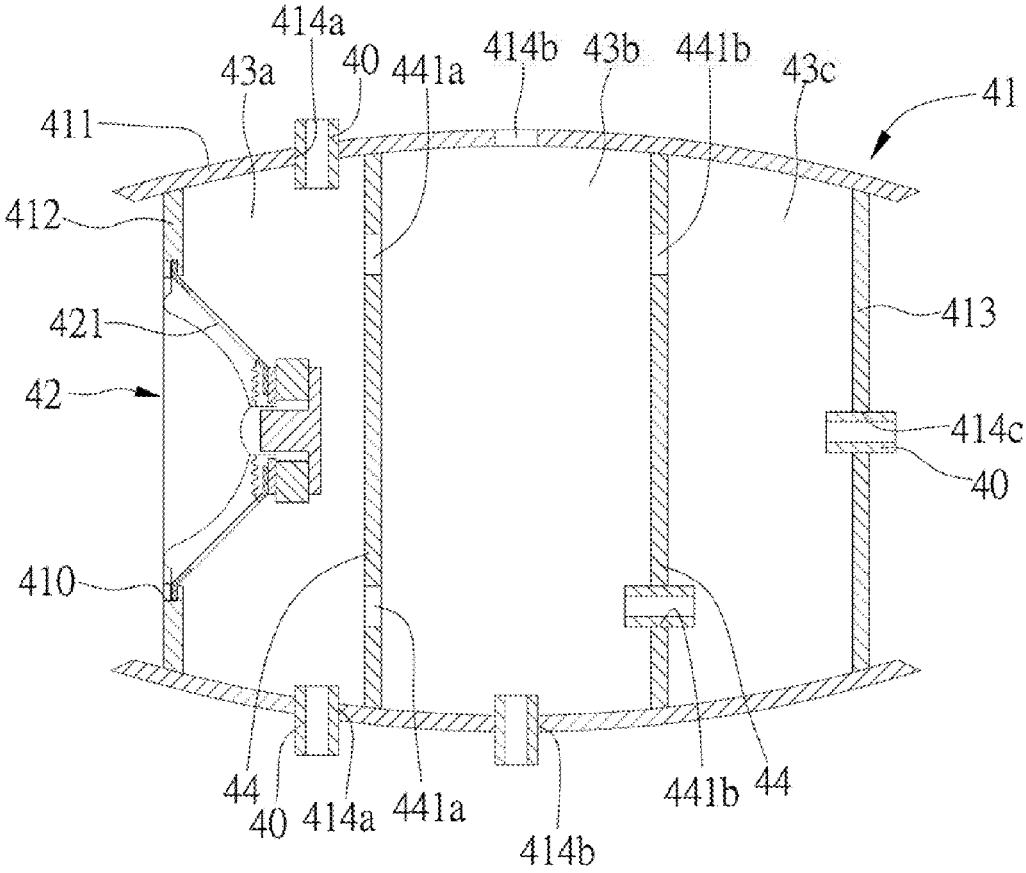
FIG. 5 is a side cutaway view illustrating the speaker apparatus in accordance with a second preferred embodiment of the present invention, similar to FIG. 3A.

FIG. 5 is a side cutaway view illustrating the speaker apparatus in accordance with the second embodiment of the present invention. The difference between this and the first embodiment lies in the addition of an one-way valve in each of the air venting holes and some of the air apertures for limiting air flow to an intended direction.

As shown, the speaker apparatus of the present invention consists of a sound box 41 and a speaker 42. The sound box 41 is of the shape of a wine barrel and is formed by a plurality of arced side boards 411, a top board 412 connecting with the upper ends of the side boards 311, and a bottom board 413 connecting with the lower ends of the side boards 311, the top and bottom boards 412, 413 being parallel to each other. Once again, the shape of a wine barrel means that the diameter in the middle of the sound box 41 is larger than the diameters of the upper and lower portions thereof. At least an installation hole 410 is formed in the top board 412 for mounting a speaker therein. The sound box 41 is divided by a pair of isolating boards 44 into three air chambers 43*a*, 43*b*, 43*c*. At least one of the isolating boards 44 has a pair of air apertures 441*a*, 441*b* formed therein, respectively. The air chambers 43*a*, 43*b*, 43*c* are interconnect with one another via at least one of the air apertures 441*a*, 441*b*. A plurality of air venting holes 414*a*, 414*b* in communication with the outside are formed in at least one of the arced side boards 411 in position corresponding to at least one of the air chamber 43*a*, 43*b*. Also, an air venting hole 414*c* in communication with the outside is formed in the bottom board 413 of the sound box 41, wherein each of the air venting holes 414*a*, 414*b*, 414*c* and air apertures 441*a*, 441*b* may optionally include an one-way valve 40, and the number and configuration of air apertures 441*a*, 441*b* and air venting holes 414*a*, 414*b*, 414*c* to be formed in the isolating boards 44 and the side board 411 may vary depending on the actual requirements. The speaker 42 is mounted in the at least an installation hole 410 of the top board 412, the speaker 42 having a cone 421 with the capable of producing vibration, the axis of the speaker 42 being perpendicular to the installation plane of isolating boards 44.

As with the first embodiment, the number of air chambers 43*a*, 43*b*, 43*c* corresponds to the resonant frequency ranges of the speaker 42. Here, with the sound box 41 is divided into three air chambers 43*a*, 43*b*, 43*c*, there are three different frequency sections, A, B, C, each corresponding to a resonant frequency range of the speaker 42. In the A frequency section of the speaker resonant frequency range, the cone 421 of the speaker 42 moves backward and generates a nearly instant air pressure wave into the air chamber 33*a*, and, before the generated air pressure is dispersed through the air venting holes 414*a* and the air apertures 441*a*, an air cushion enabling the speaker 42 to produce sounds in the A frequency section is formed. The air cushion is then effectively vented out through the air venting hole 414*a* and the air aperture 441*a* without causing interference with a successively formed air cushion.

In this embodiment, each of the air venting holes 414*a*, 414*b* and air apertures 441*a*, 441*b*, 441*c* may optionally include an one-way valve 40 for limiting air flow to an intended direction and further ensuring full dispersion of the air cushion so as to avoid interference caused thereby. Also note that the number of the air chambers 43*a*, 43*b*, 43*c* may vary depending on actual requirements and design choices.

Compared to conventional speakers, the speaker apparatus proposed by the present invention is characterized by employing a sound box formed by a finished oak bucket or a used arc-shaped wine barrel whose contours match with the cone shaped speaker, thus allowing original audio sounds to be reproduced and also facilitating reclamation of used oak barrels or buckets, thus aiding with environmental protection and reducing manufacturing costs.

While illustrative embodiments are provided in the above description, such embodiments are for illustration of the principles and functions of the present invention only and they are not to be construed restrictively. Various modifications and variations of the present invention will be obvious to those skilled in the art and yet still fall within the spirit and scope of the invention as set forth in the following claims.

The invention claimed is:

1. A speaker apparatus, comprising:

a sound box being in a wine barrel shape and formed by a plurality of arced side boards, a top board coupled to upper ends of the arced side boards, and a bottom board coupled to lower ends of the arced side boards, the top and bottom boards being parallel with each other, wherein the sound box comprises a plurality of air chambers therein, and the top board is formed with at least an installation hole, wherein the sound box is divided by at least an isolating board into the plurality of air chambers, wherein the plurality of air chambers are interconnected with one another via at least an air aperture formed through the at least an isolating board, and wherein the at least an air aperture is further mounted with an one-way valve for limiting air flow to a single intended direction; and a speaker installed in the installation hole of the top board.

2. The speaker apparatus according to claim 1, wherein at least an air venting hole is formed through at least one of the arced side boards for communicating the plurality of air chambers with the outside.

3. The speaker apparatus according to claim 2, wherein the at least an air venting hole is formed in at least one of the arced side boards in position corresponding to at least one of the plurality of air chambers.

4. The speaker apparatus according to claim 2, wherein the at least an air venting hole is further mounted with an one-way valve for limiting air flow to a single intended direction.

5. The speaker apparatus according to claim 2, wherein the at least an isolating board is disposed parallel to the top/bottom board in the sound box, so as to make the plurality of air chambers in parallel.

6. The speaker apparatus according to claim 1, wherein an axis of the speaker is perpendicular to an installation plane of the at least an isolating board.

7. The speaker apparatus according to claim 1, wherein the wine barrel shape of the sound box has a diameter in a middle portion of the sound box larger than those of upper and lower portions thereof.

8. The speaker apparatus according to claim 1, wherein the sound box is an oak barrel/bucket.

* * * * *